US008971733B2

(12) United States Patent
Hayakawa et al.

(10) Patent No.: US 8,971,733 B2
(45) Date of Patent: Mar. 3, 2015

(54) IMAGE FORMING UNIT AND IMAGE FORMING APPARATUS

(75) Inventors: Yoichi Hayakawa, Tokyo (JP); Masahiro Sonoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 53 days.

(21) Appl. No.: 13/586,030

(22) Filed: Aug. 15, 2012

(65) Prior Publication Data

US 2013/0045017 A1 Feb. 21, 2013

(30) Foreign Application Priority Data

Aug. 19, 2011 (JP) ..... 2011-179356

(51) Int. Cl.
*G03G 15/00* (2006.01)
*G03G 15/08* (2006.01)
*G03G 21/18* (2006.01)

(52) U.S. Cl.
CPC ..... *G03G 15/0863* (2013.01); *G03G 21/1878* (2013.01)
USPC ..... 399/24; 399/25; 399/27

(58) Field of Classification Search
CPC ..... G03G 21/1875; G03G 21/1878; G03G 21/1889; G03G 2221/1663
USPC ..... 399/25–27
See application file for complete search history.

(56) References Cited

U.S. PATENT DOCUMENTS

2001/0055493 A1* 12/2001 Asanuma et al. ..... 399/25
2003/0091353 A1* 5/2003 Hiroshima et al. ..... 399/25
2006/0216046 A1 9/2006 Hatakeyama
2007/0166056 A1* 7/2007 Inoue et al. ..... 399/24

FOREIGN PATENT DOCUMENTS

JP 08-211818 A 8/1996
JP A-2006-267528 10/2006
JP 2007-017724 A 1/2007
JP 2010-181720 A 8/2010

OTHER PUBLICATIONS

JPO Search Report, Jul. 10, 2013.*
JPO Office Action, Jul. 16, 2013.*

* cited by examiner

*Primary Examiner* — David Gray
*Assistant Examiner* — Sevan A Aydin
(74) *Attorney, Agent, or Firm* — Muncy, Geissler, Olds & Lower, P.C.

(57) ABSTRACT

An image forming unit includes an image forming part forming an image, and a developer containing part containing a developer, removably installed to the image forming part, and supplying the developer to the image forming part. The image forming part includes a first memory part storing first usage information indicating usage information of the image forming part and second usage information indicating usage information of the developer in the image forming part.

12 Claims, 6 Drawing Sheets

IMAGE FORMING UNIT AND IMAGE FORMING APPARATUS

CROSS REFERENCE TO RELATED APPLICATION

The present application is related to, claims priority from and incorporates by reference Japanese Patent Application No. 2011-179356, filed on Aug. 19, 2011.

TECHNICAL FIELD

The present application relates to an image forming unit and an image forming apparatus of which a replacement member is removably installed.

BACKGROUND

Conventionally, an electrographic image forming apparatus, such as a photocopy machine, a facsimile device and a printer, includes an image forming unit for forming an image. The image forming apparatus is configured with a photosensitive drum, a charging part, a development part, a cleaning part, and a toner cartridge, and the like. The charging part, the development part, the cleaning part, and the toner cartridge are disposed around the photosensitive drum. The image forming apparatus forms a toner image on the photosensitive drum. Toner to be supplied on the photosensitive drum is supplied by the toner cartridge that contains toner as a developer installed to an image forming unit main body. The photosensitive drum configuring the image forming unit has a life as a consumable item and needs to be replaced at the end of the life. The toner cartridge to be installed also needs to be replaced when the contained toner runs out. Accordingly, the image forming unit is removably installed to the image forming apparatus main body. Furthermore, the toner cartridge is removably installed to the image forming unit main body. In order to inform a user of a timing for replacing the parts to be replaced, the life of the image forming unit main body and a remaining toner amount are controlled by a controller of the image forming apparatus (see JP Laid-Open Patent Application No. 2006-267528 (page 7, FIG. 4)).

In the conventional art, it is difficult to determine a replacement time of a consumable item when the replaceable consumable item is removed from an apparatus before coming to its life and is installed and used in another apparatus.

SUMMARY

An image forming unit disclosed in the application includes an image forming part forming an image, and a developer containing part containing a developer, removably installed to the image forming part, and supplying the developer to the image forming part. The image forming part includes a first memory part storing first usage information indicating usage information of the image forming part and second usage information indicating usage information of the developer in the image forming part.

Accordingly, a replacement time of an image forming part and a developer containing part configuring an image forming unit is accurately determined. For example, even though the developer containing part is replaced, performing print is prevented when the image forming part has reached a replacement time.

DETAILED DESCRIPTION OF EMBODIMENTS

First Embodiment

Figure 1:
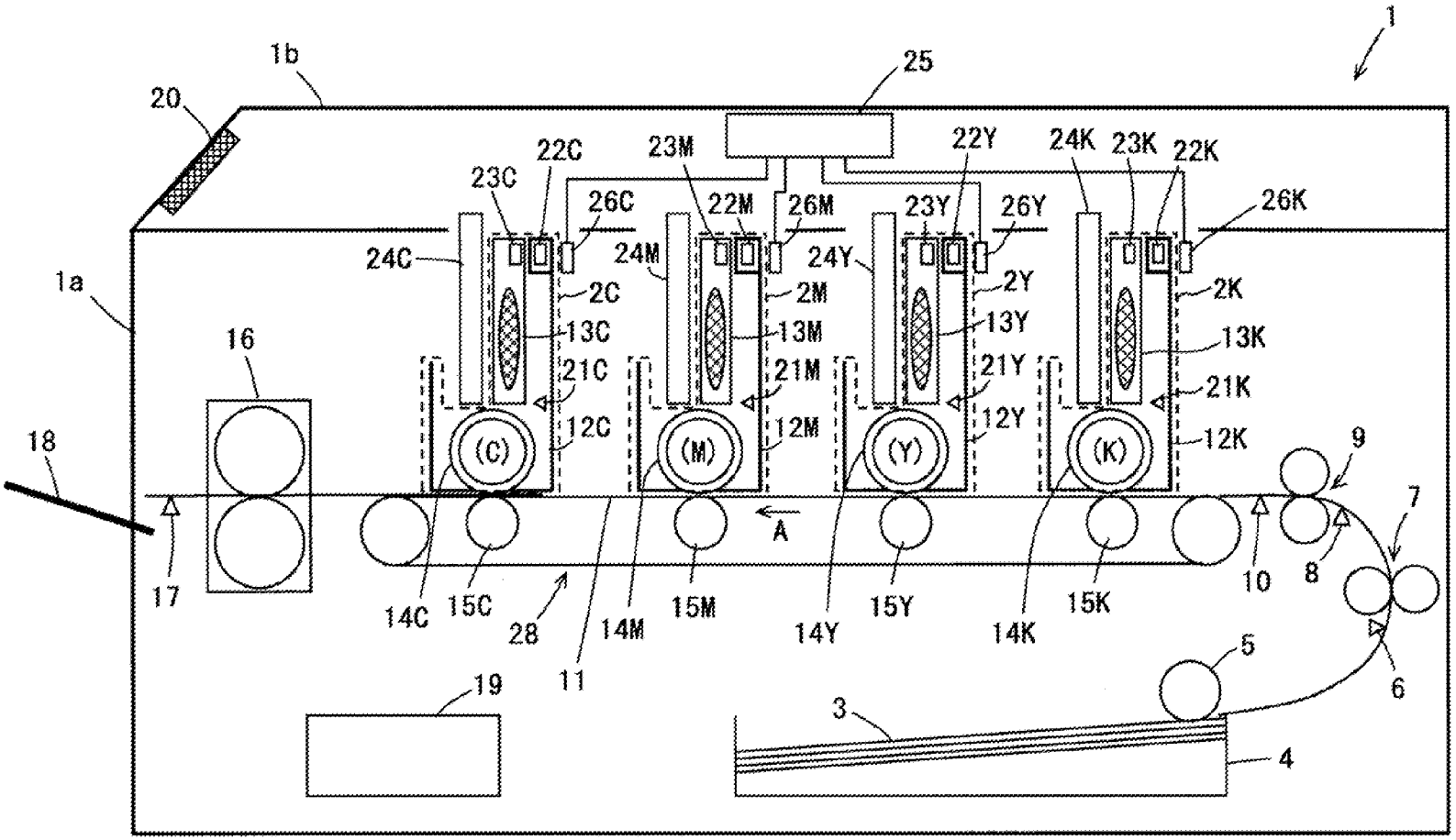
FIG. 1 is a main part configuration diagram illustrating a main part configuration of a color printer as an image forming apparatus of a first embodiment based on the present application.

FIG. 1 is a main part configuration diagram illustrating a main part configuration of a color printer as an image forming apparatus of a first embodiment based on the present application. As shown in FIG. 1, the color printer 1 is configured from a main body 1*a* and a top cover part 1*b*.

In the main body part 1*a*, a recording sheet containing part 4, a sheet supply roller 5, a traveling sensor 6, a first registration roller 7, a traveling sensor 8, a second registration roller 9, a traveling sensor 10, an image forming unit 2K for black, an image forming unit 2Y for yellow, an image forming unit 2M for magenta, an image forming unit 2C for cyan, a fuser 16, a traveling sensor 17, and an ejection stacker part 18 are disposed in order from the upstream side of a carrying path of a recording sheet 3 as a recording medium.

Each of transfer rollers 15K, 15Y, 15M and 15C (if not necessary to be especially distinguished, may be referred to as a transfer roller 15) are disposed at respective positions facing the image forming units 2K, 2Y, 2M, 2C (if not necessary to be especially distinguished, may be referred to as an image forming unit 2). A carrying belt unit 28 having a carrying belt unit 11 is provided in the carrying path. Each of the four transfer rollers 5 and each of the image forming units 2 are disposed across the carrying path so as to face each other. The carrying belt unit 11 carries the recording sheet 3 between these transfer rollers 15 and these image forming units 2.

The recording sheet 3 on which an image is printed by the color printer 1 is contained in the recording sheet containing part 4 in a state where a plurality of sheets are stacked. The sheet supply roller 5 feeds each recording sheet 3 from the recording sheet containing part 4. The first registration roller 7 and the second registration roller 9 carry the recording sheet 3 fed from the recording sheet containing part 4 to the carrying belt unit 28 by the sheet supply roller 5.

In the carrying path of the recording sheet 3, the traveling sensor 6 and the traveling sensor 8 disposed in front of the first registration roller 7 and the second registration roller 9 detect the recording sheet 3 has reached, and obtain an operation timing for each of the registration rollers. The traveling sensor 10 disposed at the downstream of the second registration roller 9 detects the recording sheet 3 that has reached to detect a timing of image forming onto the recording sheet 3.

The image forming units 2K, 2Y, 2M, 2C are configured from respective forming parts 12K, 12Y, 12M, 12C (equivalent to an image forming unit main body part excluding the toner cartridge)(if not necessary to be especially distinguished, may be referred to as an image forming part 12), and respective toner cartridges 13K, 13Y, 13M, 13C (if not necessary to be especially distinguished, may be referred to as a toner cartridge 13).

The image forming parts 12K, 12Y, 12M, 12C include respective photosensitive drums 14K, 14Y, 14M, 14C (if not necessary to be especially distinguished, may be referred to as a photosensitive drum 14), respective remaining toner amount detection parts 21K, 21Y, 21M, 21C (if not necessary to be especially distinguished, may be referred to as a remaining toner amount detection part 21), and respective first memory tags 22K, 22Y, 22M, 22C as a first memory part (if not necessary to be especially distinguished, may be referred to as a first memory tag 22). Each of the toner cartridges 13K, 13Y, 13M, 13C as a corresponding developer containing part includes toner as a developer for black (K), yellow (Y), magenta (M), or cyan (C), and respective second memory tags 23K, 23Y, 23M, 23C as a second memory part (if not necessary to be especially distinguished, may be referred to as a second memory tag 23). Toner as a developer and a toner cartridge as a developer cartridge are described as an example. However, as a developer, the present invention may be applied to an image forming unit using liquid ink or an ink ribbon as toner instead of powdered toner.

Each of the photosensitive drums 14 forms an electrostatic latent image corresponding to print data on the drum surface using an electrostatic force for each color, and holds a toner image. The toner image is developed by a developer such as toner for a color to which an electrostatic latent image corresponds, and is transferred onto the recording sheet 3.

The toner cartridge 13 includes the second memory tag 23 and contains toner as a developer. The toner cartridge 13 is removably installed to the image forming part 12 of the image forming unit 2. The toner cartridge 13 supplies the toner that the toner cartridge 13 contains inside the image forming part 12 when the toner cartridge 13 is installed. The remaining toner amount detection part 21 as a remaining developer amount detection part detects a remaining toner amount in the image forming part 12 supplied from the installed toner cartridge 13. The remaining toner amount detection part 21 transmits toner low information that informs that the remaining toner amount is equal to or lower than a predetermined value (predetermined lower value) to a main controller 30 (FIG. 2) later described. Hereinafter, a case where the remaining toner amount in the image forming part 12 is equal to or lower than the predetermined value may be referred to as toner low.

The first memory tag 22 and the second memory tag 23 respectively include a nonvolatile memory, and are memory tags that are wirelessly communicable to a radio frequency (RF) reading and writing controller 25 (FIG. 2) later-described. FIG. 3A and FIG. 3B are block diagrams illustrating an internal configuration of the first memory tag 22 and the second memory tag 23. As illustrated in FIG. 3A, as consumable item information, photosensitive body rotation number information as an accumulated usage amount (first usage information) of the corresponding photosensitive drum 14 of the image forming part 12, and toner low history information A as remaining amount information of toner (second usage information later-described are stored at address 1 and address 2, respectively, in the first memory tag 22. In the second memory tag 23 later-described, toner low history information B as remaining amount information of toner (third usage information) is stored in address 1.

Since the image forming part 12 and the toner cartridge 13 of the image forming units 2 respectively need to be replaced as replacement parts, the image forming unit 2 is configured so as to be removably installed with respect to the color printer 1 main body, and the toner cartridge 13 is configured so as to be removably installed with respect to the image forming unit main body (image forming part 12).

Each of the transfer rollers 15K, 15Y, 15M, 15C is disposed across the carrying belt unit 11 so as to face corresponding one of the photosensitive drums 14K, 14Y, 14M, 14C, and transfers each color formed on the periphery surface of each of the photosensitive drums 14K, 14Y, 14M, 14C on an image formation surface of the recording sheet 3 carried by the carrying belt unit 11 by overlaying the toner images. A high voltage is applied to the photosensitive drum 14 and the transfer roller 15 by a high voltage power source 19 disposed in the main body 1*a*, and thereby electrophotographic processes including electrostatic charging/development/transfer are allowed.

The fuser 16 fixes the toner image formed on the recording sheet 3 onto the recording sheet 3 using heat and pressure. In the carrying path of the recording sheet 3, the traveling sensor 17 disposed at the downstream of the fuser 16 detects the recording sheet 3 that is eventually ejected on the ejection stacker part 18 by detecting the recording sheet 3 on which the toner image is fixed.

Each of the above mentioned traveling sensors 6, 8, 10, 17 is connected via a cable to the main controller 30 (see FIG. 2) later-described. In addition, each of the rollers (sheet supply roller 5, first registration roller 7, second registration roller 9, photosensitive drum 14, transfer roller 15, and fuser 16) is mechanically driven by an actuator (not shown) to allow the recording sheet 3 to be carried in downstream direction of the carrying path.

Meanwhile, the top cover part 1*b* includes light emitting diode (LED) heads 24K, 24Y, 24M, 24C (if not necessary to be especially distinguished, may be referred to as an LED head 24), the RF reading and writing controller 25, antenna parts 26K, 26Y, 26M, 26C (if not necessary to be especially distinguished, may be referred to as an antenna part 26) electrically connected to the RF reading and writing controller 25, and a display part 20.

The LED heads 24K, 24Y, 24M, 24C are exposure parts that are respectively disposed so as to face the corresponding photosensitive drums 14K, 14Y, 14M, 14C of each of the image forming units 2 and irradiates light according to print data to be received. The LED heads 24K, 24Y, 24M, 24C are displaceably supposed so as not to prevent the top cover part 1*b* from being opened and closed. The LED head 24 approaches the surface of the photosensitive drum 14 and become exposable when the top cover part 1*b* is closed, and is connected via the cable to the main body 1*a* of the color printer 1. Each of the antenna parts 26 is disposed so as to face the corresponding first memory tag 22 and second memory tag 23 of the image forming unit 2 in the vicinity of the first and second memory tags 22 and 23 when the top cover part 1*b* is closed.

The display part 20 is a printed circuit board configured by a liquid crystal display (LCD) panel, a switch and the like. The display part 20 is connected via the cable to the main controller 30 (see FIG. 2) later-described allows the display of the status of the color printer 1 and input operation by a user. The LCD panel displays 24 characters×2 lines for example.

Figure 2:
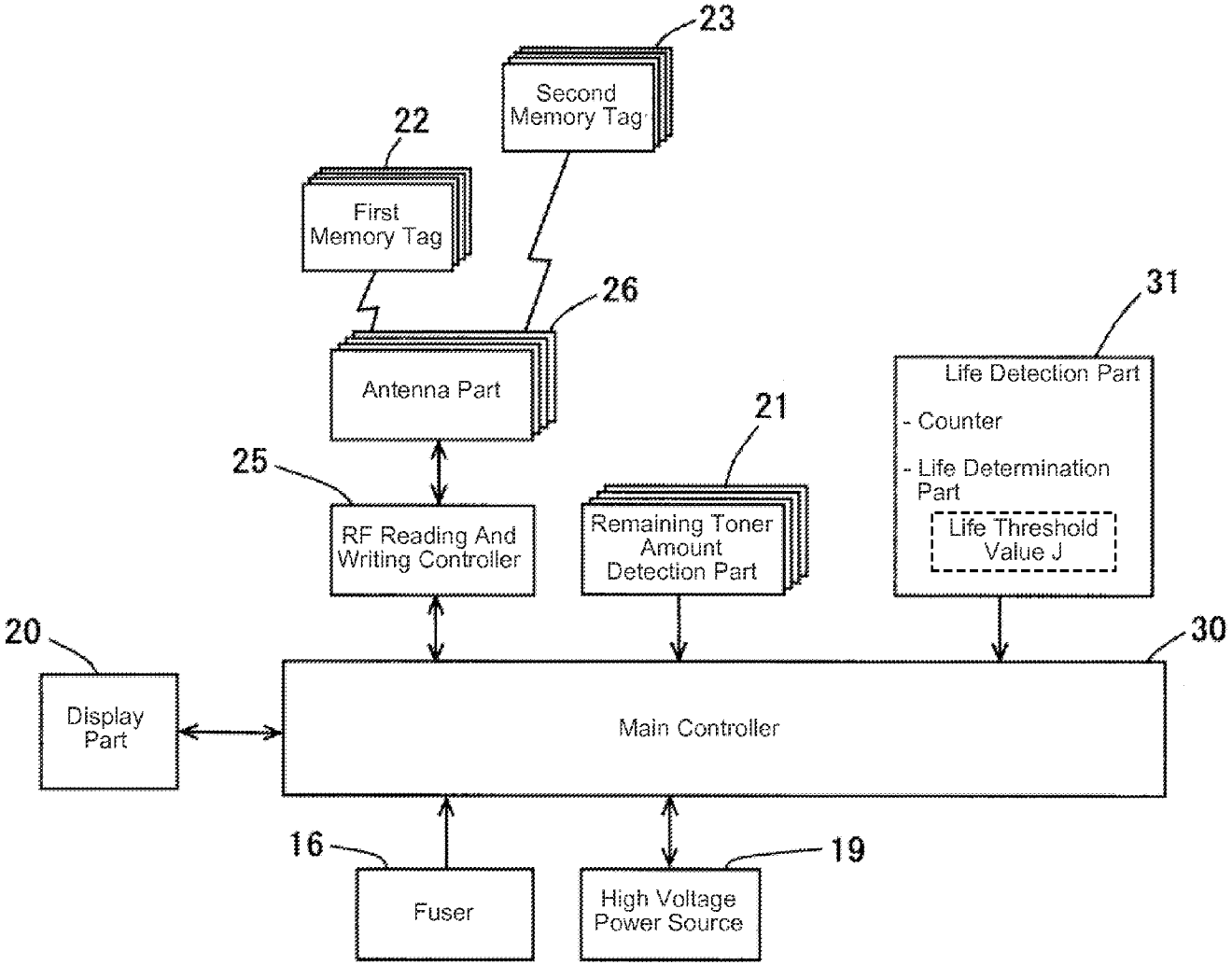
FIG. 2 is a block diagram for explaining a configuration of a control system of the entire color printer in the first embodiment.
Figure 3A:
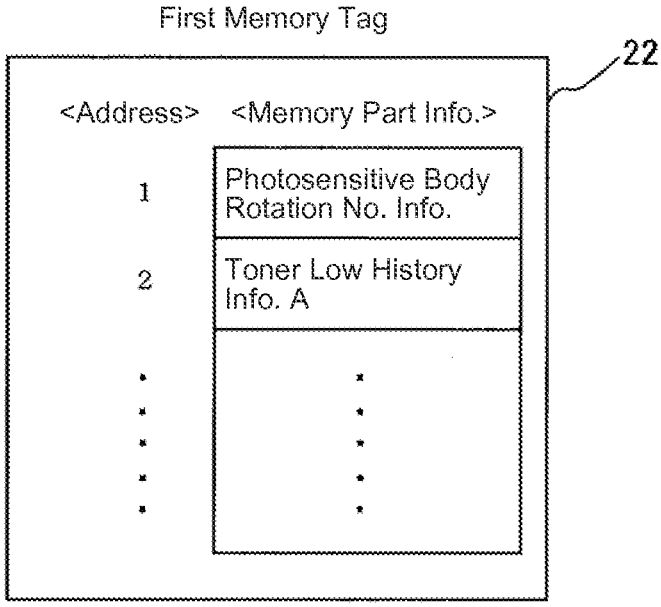
FIG. 3A is a block diagram illustrating an internal configuration of a first memory tag 22.
Figure 3B:
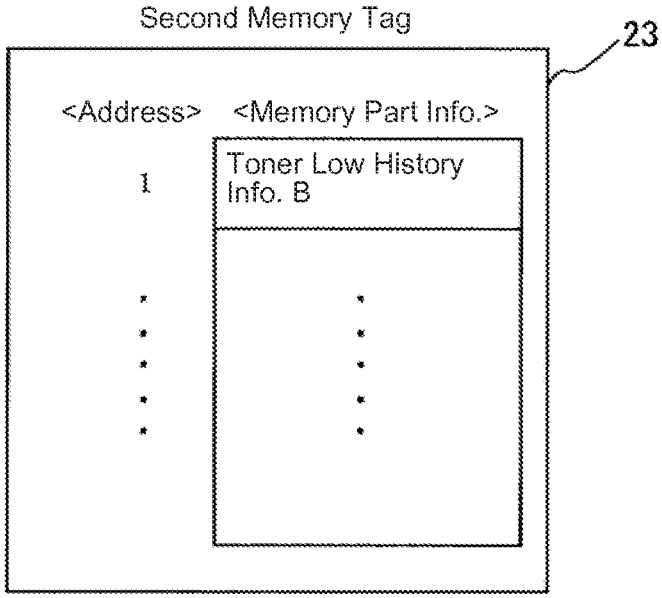
FIG. 3B is a block diagram illustrating an internal configuration of a second memory tag 23.

The RF reading and writing controller 25 is connected via the cable to the antenna part 26 and the main controller 30 (FIG. 2). The RF reading and writing controller 25 is supplied via the cable with control signals and power from the main body 1*a* of the color printer 1. The RF reading and writing controller 25 functions as interface (I/F) with the main controller 30 and performs wireless communication control such as reading/writing data of the first memory tag 22 and the second memory tag 23 disposed so as to face the antenna part 26. The RF reading and writing controller 25 and the antenna part 26 correspond to a reading part or an information reading and writing part.

FIG. 2 is a block diagram for explaining a control system configuration of the entire color printer in the embodiment. In addition, in FIG. 2, compositions described as four-layer blocks are respectively configured for each of the colors of K, Y, M, C, and perform substantially same operation. Therefore, in FIG. 2, the compositions are described as four-layer blocks for convenience, are explained without specifying the color system, and are explained with distinguishing each of four color systems if needed.

The main controller 30 as a controller includes, for example, a CPU that is disposed in the main body 1*a* and controls various operations of the color printer. The main controller 30 performs various processes according to a program for controlling the entire color printer 1. The main controller 30 is connected via an input/output port to the fuser 16, the high voltage power source 19, the display part 20, the RF reading and writing controller 25, the remaining toner amount detection part 21, and a life detection part 31. In addition, each of traveling sensors (not shown) and an actuator (not shown) are also connected to and controlled by the main controller 30.

The life detection part 31 includes a counter that counts a rotation number of the photosensitive drum 14 in the image forming part 12 and a life determination part. The life determination part determines that the image forming part 12 of the image forming unit 2 having the corresponding photosensitive drum 14 has come to its life, when a value of the photosensitive body rotation number information later-described exceeds a predetermined life threshold value J (first upper limit). The value of the photosensitive body rotation number information is an accumulated value of the counted rotation number. The accumulated rotation number of the photosensitive drum 14 herein indicates a rotation number counted from the start of use of the image forming part 12.

The remaining toner amount detection part 21 as the remaining developer amount detection part that detects a remaining toner amount is configured to, for example, read the remaining toner amount using a reflection plate and an optical sensor. The reflection plate is linked to an agitation bar that agitates the toner in the image forming part 12. This agitation bar slowly moves due to a load of the toner when there is a large amount of toner in the image forming part 12 and moves fast due to a less load with respect to the agitation bar when there is a small amount of toner in the image forming part 12. Therefore, the remaining toner amount detection part 21 monitors a detection interval of reflection light from the reflection plate and transmits a signal to the main controller 30. The detection interval is longer when the toner in the image forming part 12 is much and is shorter when the toner in the image forming part 12 is less. The signal indicates that the toner is low when the remaining toner amount in the image forming part 12 is reduced to equal to or less than a predetermined value being near zero. It is determined that there is no toner in the toner cartridge 13 that supplies the toner into the image forming part 12 at this time.

In the above mentioned configuration, basic print operations performed by the color printer 1 are explained first with reference to, mainly, FIGS. 1 and 2.

When the color printer 1 receives a print instruction from a host controller such as a personal computer (PC), the color printer 1 performs the print operation as various operations are controlled by the main controller 30 based on a control program. As each actuator such as a motor is controlled, the sheet supply roller 5, the first registration roller 7 and the second registration roller 9 are mechanically driven, and thereby the recording sheet 3 is carried from the recording sheet containing part 4 into the inside of the color printer. The timings when the first registration roller 7 and the second registration roller 9 are driven is decided by detecting a position of the carried recording sheet 3 by the traveling sensors 6 and 8.

When the traveling sensor 10 detects a leading edge of the recording sheet 3, the printing process operation starts. Thereby, the high voltage power source 19 is controlled, a necessary voltage for charging and development at the photosensitive drum 14 is applied to a charging device, a development device, and the like (not shown) of the image forming unit 2. The drum surface of the photosensitive drum 14 is uniformly charged by the charging device (not shown). Furthermore, recording light based on a print data signal from the host controller is irradiated from the LED head 24, and the drum surface of the photosensitive drum 14 are exposed. On the exposed drum surface of the photosensitive drum 14, print data is formed as an electrostatic latent image. At this time, the photosensitive drum 14 and the transfer roller 15 are driven by each of the actuators in a direction to carry the recording sheet 3 in the downstream direction (direction indicated by allow A).

The electrostatic latent image formed on the drum surfaces of the photosensitive drum 14 is developed by the development device (not shown) with the toner supplied from the toner cartridge 13, and thereby, on the drum surface of the photosensitive drum 14, a toner image is formed. A transfer voltage in accordance with a desirable condition is applied to the transfer roller 15 from the high voltage power source 19*a*. By this transfer roller 15, the toner image formed on the photosensitive drum 14 is transferred to the surface of the carried recording sheet 3. When the print data is color image data, the process operation for each color is performed by the image forming unit 2 and the transfer roller 15 corresponding to each of the colors K, Y, M, C, on the surface of the recording sheet 3. The color toner image is formed by sequentially transferring and overlaying each color image on the recording sheet 3.

The recording sheet 3 on which the image is formed is carried to the fuser 16, and the image is fixed to the recording sheet 3 by heat and pressure. The fuser 16 includes two rollers in which a heating element such as a halogen is built. By a temperature detection element such as a thermistor, a fusion temperature is detected. A temperature is controlled so as to fuse the toner at an appropriate fusion temperature. The recording sheet 3 that undergoes the above mentioned print process passes the traveling sensor 17 and is ejected to the ejection stacker part 18.

Next, the first memory tag 22, the second memory tag 23, and consumable item information recorded in the first and second memory tags 22 and 23 are explained.

As mentioned above, the photosensitive body rotation number information as usage information of the photosensitive drum 14 is information for determining the life of the image forming part 12 of the image forming unit 2, and here corresponds to the print page number. When printing is performed, the main controller 30 sequentially updates a value of the photosensitive body rotation number information stored in the first memory tag 22 via the RF reading and writing controller 25, according to the print page number sequentially counted by the life detection part 31. Thereby, the value of the photosensitive body rotation number information stored in the first memory tag 22 becomes the accumulated rotation number of the photosensitive drum 14 of the image forming part 12 holding this first memory tag 22.

Meanwhile, the main controller 30 reads the photosensitive body rotation number information from the first memory tag 22 and transmits the photosensitive body rotation number information to the life detection part 31 at a predetermined timing before the printing is performed. The life detection part 31 compares the received photosensitive body rotation number information and the life threshold value J stored in advance, and judges whether or not the image forming part 12 of the image forming unit 2 including this photosensitive drum 14 has come to its life. For example, assuming that the life threshold value J is 30,000 rotations, when the read photosensitive body rotation number information is equal to or less than 30,000 rotations, the life detection part 31 judges that the photosensitive dram 14 has not come to its life, and when the read photosensitive body rotation number information exceeds 30,000 rotations, the life detection part 31 judges that the photosensitive dram 14 has come to its life.

In addition, as mentioned above, when the main controller 30 receives from the remaining toner amount detection part 21 the toner low signal that indicates that the remaining toner amount in the image forming part 12 is reduced to equal to or less than the predetermined remaining amount level near zero, the main controller 30 sets via the RF reading and writing controller 25 both the toner low history information A in the first memory tag 22 and the toner low history information B in the second memory tag 23 to "1". The toner low history information A and the toner low history information B are set to "0" in advance until the toner low history information A and the toner low history information B are set to "1".

For the toner cartridge 13 in unused state sets, the toner low history information B is set to "0" in advance. Therefore, as described later, when the toner cartridge 13 is replaced with an unused cartridge, the history information of the toner low history information A and history information of the toner low history information B may differ until toner is detected to be low.

In the above description, the system is explained without specifying the corresponding color. However, the same process is actually performed in each of the four color systems K, Y, M, C.

Figure 4:
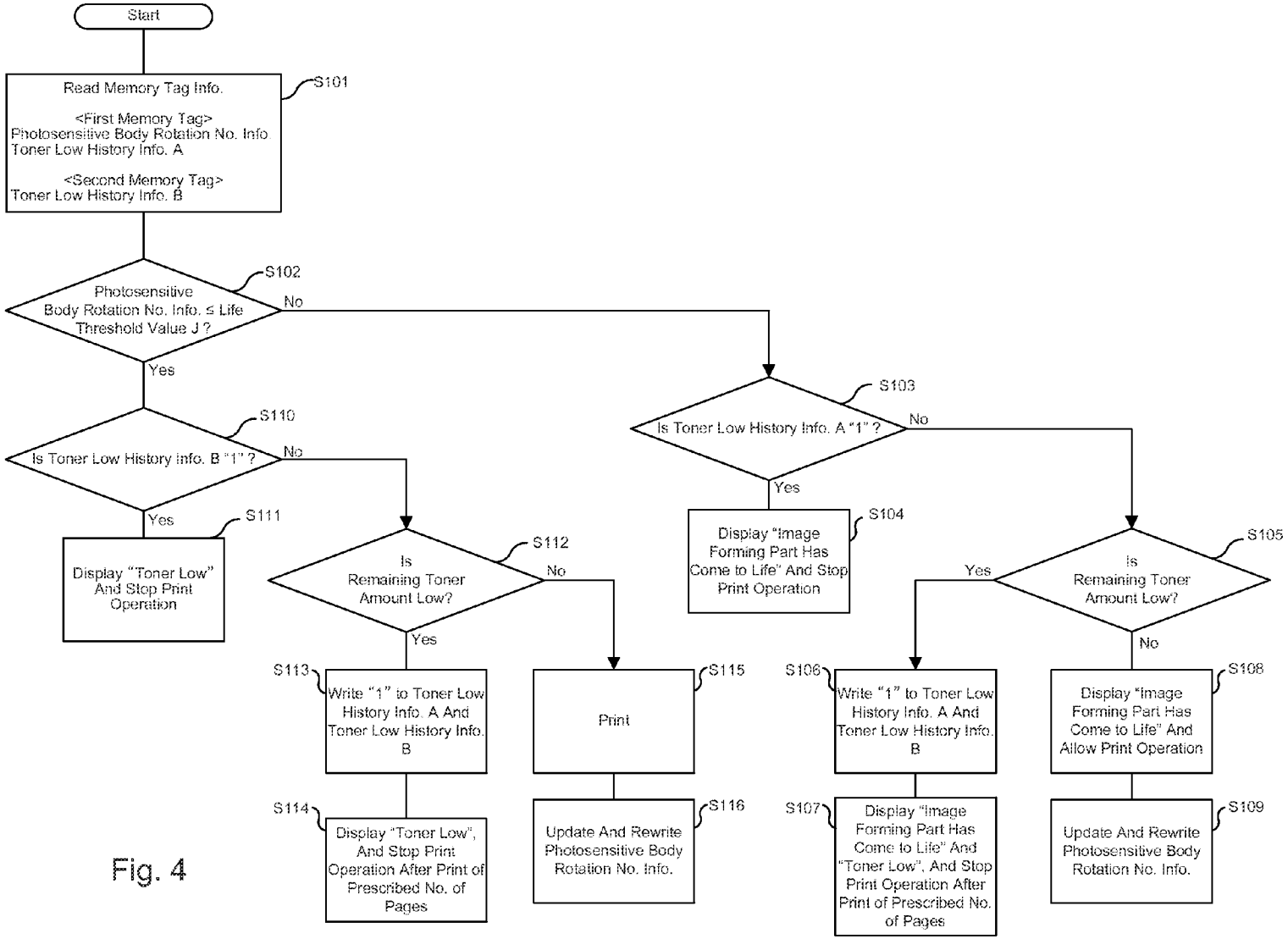
FIG. 4 is a flow diagram explaining a process at a replacement time of an image forming part and/or a toner cartridge performed by the image forming apparatus of the first embodiment.

FIG. 4 is a flow diagram explaining a process at a replacement time of the image forming part 12 and/or the toner cartridge 13 performed by the image forming apparatus of the first embodiment. The process method at the above mentioned replacement time will be explained with reference to this flow diagram. Here, the process will be explained without specifying the corresponding color system. However, the actually same process is performed in each of the four color systems K, Y, M, C.

When power of the apparatus of which the toner cartridge 13 may have been replaced is turned on, or when the cover part 1*b* is opened and closed, the main controller 30 controls the RF reading and writing controller 25, and begins RF communication, via the antenna part 26, with the first memory tag 22 included in the image forming part 12 and the second memory tag 23 included in the toner cartridge 13. Then, the main controller 30 reads from the first memory tag 22 the photosensitive body rotation number information and the toner low history information A of the image forming part 12, and reads from the second memory tag 23 the toner low history information B (S101).

The main controller 30 transmits the read photosensitive body rotation number information to the life detection part 31. The life detection part 31 compares the read photosensitive body rotation number information and the life threshold value J, and transmits a judgment result indicating whether or not the rotation number of this photosensitive drum 14 is equal to or less than the life threshold value J (photosensitive body rotation number≤life threshold value J) to the main controller 30 (S102). When the rotation number of the photosensitive drum 14 exceeds the life threshold value J (NO, S102), the main controller 30 determines that the image forming part 12 including this photosensitive drum 14 has come to its life, and further checks the toner low history information A in the first memory tag 22 that the image forming part 12 includes. That is, the main controller 30 checks whether or not the toner low history information A is "1" (S103). Here, when the toner low history information A in the first memory tag 22 is "1", it indicates a history that the remaining toner amount in the image forming part 12 is judged to be equal to or less than the predetermined remaining toner amount level near zero in previous (past) remaining toner amount detection.

Here, when the toner low history information A in the first memory tag 22 is judged to be "1", (YES, S103), the main controller 30 displays on the display part 20 a notice "the image forming part 12 has come to its life", and stops the print operation based on the judgment that the image forming part 12 has come to its life and that the remaining toner amount in the image forming part 12 is toner low (S104). Here, reasons for not displaying the toner being low will be explained below.

In S103, when the toner low history information A in the first memory tag 22 is judged to be "0", (NO, S103), that is, when the remaining toner amount in the image forming part 12 is not judged to be low, the remaining toner amount in the image forming part 12 is detected again whether or not the remaining toner amount is low (S105). Here, as described later, since a print process is performed since the previous remaining toner amount detection and the current remaining toner amount detection, a judgment is made as to whether or not the remaining toner amount has turned low during such print process.

In S105, when the remaining toner amount in the image forming part 12 is judged to be low (YES, S105), the main controller 30 rewrites, via RF reading and writing controller 25, both the toner low history information A in the first memory tag 22 and the toner low history information B in the second memory tag 23 to "1" to indicate that there is a toner low history (S106). Then, the main controller 30 displays on display part 20 the notice "the image forming part 12 has come to its life" and the notice "toner low", and stops the print operation after printing a prescribed number of pages (S107). The "prescribed number of pages" herein indicates a predetermined print page number that is printable with the remaining toner after the remaining toner amount is determined to be low.

Meanwhile, in S105, when the remaining toner amount in the image forming part 12 is judged not to be low (NO, S105), the main controller 30 displays on display part 20 the notice "the image forming part 12 has come to its life". However, the main controller 30 allows print operation to be continued (S108). This prevents a user, who is informed neither that the life of the image forming parts 12 has reached nor that the toner is low, from encountering any inconvenience as the printing suddenly stops. In addition, this prevents the remaining toner amount in the toner cartridge 13 from being wasted.

Then, for example, when power of the apparatus is turned off, or when the top cover part 1*b* is opened and closed, the photosensitive body rotation number information in the first memory tag 22 is updated and rewritten with the counted value counted by the life detection part 31 in accordance with new printing at this time (S109).

Meanwhile, in judgment of S102, when the rotation number of the photosensitive drum 14 is judged to be equal to or less than the life threshold value J (YES, S102), the main controller 30 determines that the image forming part 12 including this photosensitive drum 14 has not come to its life yet, and checks the toner low history information B in the second memory tag 23 included in the toner cartridge 13. That is, the main controller 30 checks whether or not the toner low history information B is "1" (S110). Here, when the toner low history information B in the second memory tag 23 is "1", it indicates a history that the remaining toner amount in the image forming part 12 is judged to be low at a level equal to or less than the predetermined remaining amount level near zero in the previous (past) remaining toner amount detection. However, here, the toner cartridge 13 may be decided to be empty. In above mentioned S103, the toner low history information A in the first memory tag 22 included in the image forming part 12 is checked. In S110, the toner low history information B in the second memory tag 23 included in the toner cartridge 13 is checked. Reasons for the checking history information will be explained below.

Here, when where the toner low history information B in the second memory tag 23 is judged to be "1" (YES, S110), since the toner cartridge 13 is empty, the main controller 30 displays the notice "toner low" and encourages the user to replace the toner cartridge and stops print operation (S111). Here, the main controller 30 may display a notice "the toner cartridge is empty."

In S110, when the toner low history information B in the second memory tag 23 is judged to be "0" (NO, S110), that is, when the remaining toner amount in the image forming part 12 is not judged to be low yet, the remaining toner amount in the image forming part 12 is detected again whether or not the remaining toner amount is low (S112). Here, since the print process is performed since the previous remaining toner amount detection and the current remaining toner amount detection, a judgment is made as to whether or not the remaining toner amount has turned low during such print process.

In S112, when the remaining toner amount in the image forming part 12 is judged to be low (YES, S112), the main controller 30 rewrites, via RF reading and writing controller 25, both the toner low history information A in the first memory tag 22 and the toner low history information B in the second memory tag 23 to "1" to indicate that there is a toner low history (S113). Then, the main controller 30 displays on display part 20 the notice "toner low", and stops the print operation after printing the prescribed number of pages (S114). The "prescribed number of pages" herein indicates the predetermined print page number that is printable with the remaining toner after the remaining toner amount is determined to be low.

Meanwhile, in S112, when the remaining toner amount in the image forming part 12 is not judged to be low (NO, S112), the main controller 30 indicates that print operation can be continued (S115). For example, when power of the apparatus is turned off, or when the top cover part 1*b* is opened and closed, the photosensitive body rotation number information in the first memory tag 22 is updated and rewritten with the counted value counted by the life detection part 31 in accordance with new printing at this time (S116).

In the above mentioned process, in mentioned above S103, the toner low history information A in the first memory tag 22 included in the image forming part 12 is checked, and in S110, the toner low history information B in the second memory tag 23 included in the toner cartridge 13 is checked. Reasons for checking history information will be explained as follows.

(1) In S111, S114 or S107, when the notice "toner low" is displayed, both the first toner low history information A and the second toner low history information B are "1". Here, a case where the user replaces the toner cartridge with an unused toner cartridge of which the toner low history information B is "0" will be assumed. At this time, the first toner low history information A and the second toner low history information B indicate different history information. When the flow of FIG. 4 starts in this state, when the image forming part 12 including the photosensitive drum 14 has not come to its life yet, the process proceeds to S102, S112 and S115, and the printing can be performed. Alternatively, when the image forming part 12 including the photosensitive drum 14 has come to its life, the process proceeds to S102, S103, and S104, and the printing is stopped. Accordingly, degradation of print quality is prevented since the printing is continued though the image forming part 12 has come to its life.

(2) A case where, though the toner cartridge 13 is filled with the enough toner, the user replaces by mistake the toner cartridge 13 with a cartridge of which the toner low history information B is "1" will be assumed. When the flow of FIG. 4 starts in this state, when the image forming part 12 including the photosensitive drum 14 does not has not come to its life yet, the process proceeds to S102, S111, and the printing is stopped. Alternatively, when in the state where the image forming part 12 including the photosensitive drum 14 has come to its life, the process proceeds to S102, S103 and S104, and the printing is stopped.

As mentioned above, the image forming part 12 and the toner cartridge 13 include the memory tags. In S110, the toner low history information B in the second memory tag 23 that the toner cartridge 13 includes is checked. In S103, the toner low history information A in the first memory tag 22 that the image forming part 12 includes is checked. Thereby, the user is appropriately notified with the life time of the image forming part 12 and the replacement time of the toner cartridge 13.

In addition, since the image forming part 12 includes the first memory tag recording toner low history information A and photosensitive body rotation number information, when the image forming part 12 has come to its life and reaches low toner level, or when the toner cartridge 13 is replaced with an unused cartridge, inappropriate proceeding of print can be prevented.

As mentioned above, according to the color printer 1 of the present embodiment, there may be the following effects.

(a) The user is appropriately notified with the life time of the image forming part 12 and the replacement time of the toner cartridge 13.

(b) If an empty toner cartridge 13 is installed into an image forming part 12 of another color printer 1 by mistake, unnecessary printing is prevented since the printing is not continued.

(c) When the image forming part has come to its life and when the toner still remains, the printing is not stopped without any advance notice. However, the notice "the image forming part 12 has come to its life" is displayed and the printing is allowed when the toner still remains. Therefore, the user can pay attention to deterioration of an image and can replace the image forming part 12 without hurrying or wasting the toner in the image forming part 12.

Second Embodiment

Figure 5:
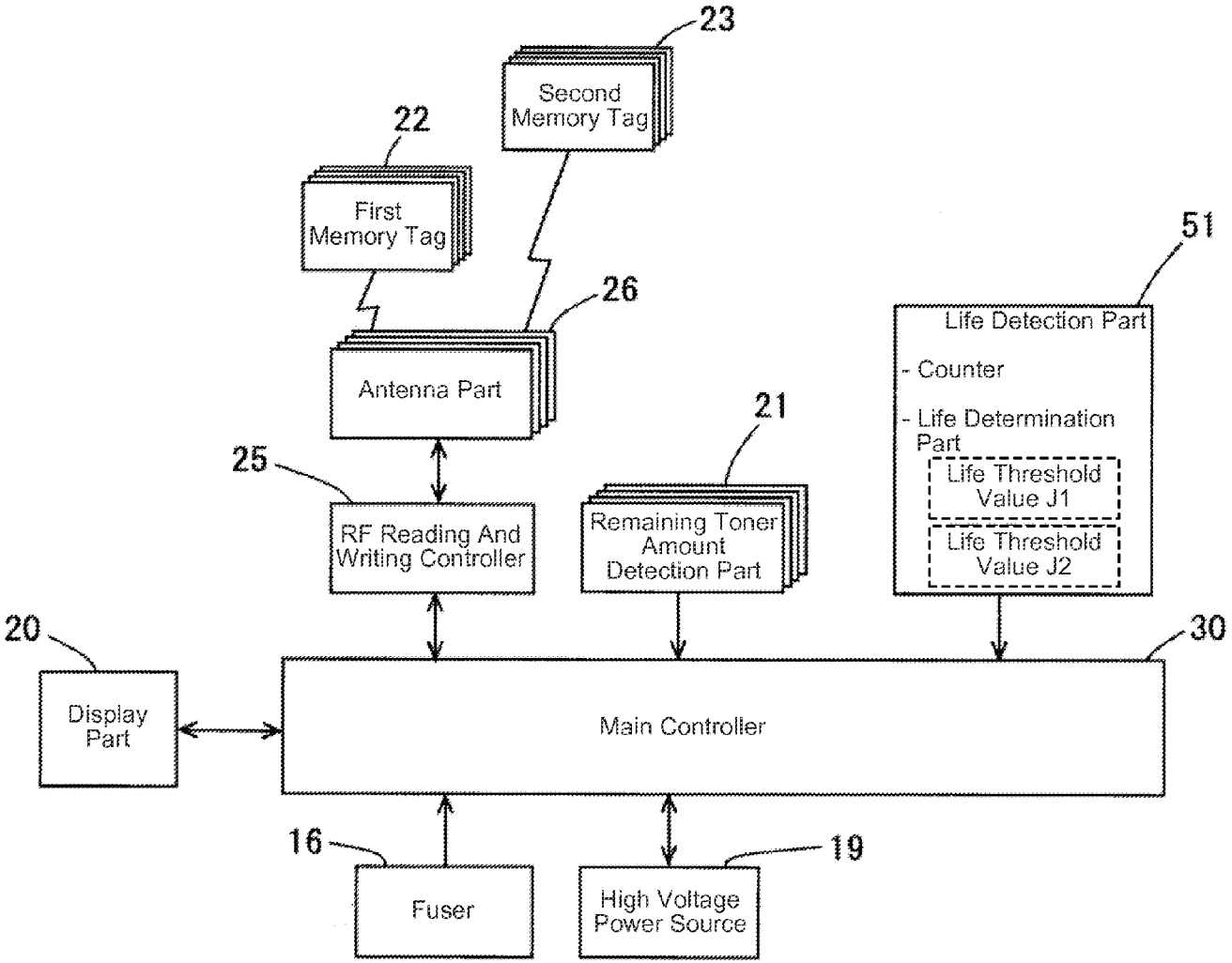
FIG. 5 is a block diagram for explaining a control system configuration of the entire color printer in a second embodiment.

FIG. 5 is a block diagram for explaining a control system configuration of the entire color printer in a second embodiment. In addition, in FIG. 5, compositions described as four-layer blocks are respectively configured for each of the colors of K, Y, M, C, and perform substantially same operation. Therefore, in FIG. 5, the compositions are described as four-layer blocks for convenience, are explained without specifying the color system, and are explained with distinguishing each of four color systems if needed.

The main difference of the block diagram of the control system shown in FIG. 5 from the above mentioned block diagram of the control system of the first embodiment illustrated in FIG. 2 is that a life determination part of the life detection part 51 compares a life threshold value J1 with a life threshold value J2, with the accumulated rotation number of the photosensitive drum 14. Accordingly, an image forming apparatus including the configuration of the block diagram of the control system shown in FIG. 5 has common parts with and different parts from the image forming apparatus having the configuration of the block diagram of the control system of the first embodiment illustrated in above mentioned FIG. 2. The same reference numbers are used, and explanation and figures are omitted, for parts that are common with the control system of the first embodiment. Different parts from the control system of the first embodiment are intensively explained.

The life detection part 51 includes the counter that counts the rotation number of the photosensitive drum 14 in the image forming part 12 and the life determination part. The life detection part compares the value of the photosensitive body rotation number information that is the accumulated value of the counted rotation number with a predetermined life threshold value J1 (second upper limit) or a predetermined life threshold value J2 (first upper limit). The life threshold value J1 is an experimentally decided value, at which, when the accumulated rotation number of the photosensitive drum 14 is equal to or more than the life threshold value J1, print quality inevitably becomes deteriorated when the printing is performed. For example, the life threshold value J1 is 35,000 rotations and the life threshold value J2 is 30,000 rotations.

Figure 6:
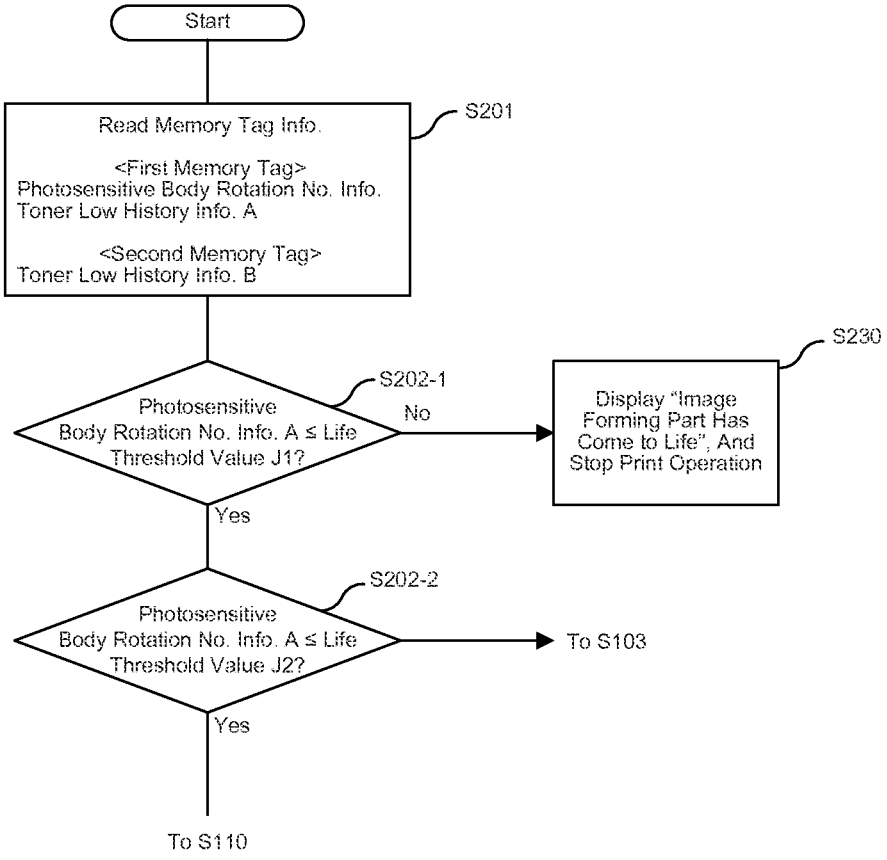
FIG. 6 is a flow diagram explaining a process at a replacement time of the image forming part and/or the toner cartridge performed by the image forming apparatus of the second embodiment.

FIG. 6 is a flow diagram explaining a process at a replacement time of the image forming part and/or the toner cartridge performed by the image forming apparatus of the second embodiment. The process method of the above mentioned replacement time will be explained with reference to this flow diagram. Here, the process will be explained without specifying the corresponding color system. However, the same process is actually performed in each of the four color systems K, Y, M, C. In addition, explanation of the process from S103 and S110 directed from S102-2 is omitted since the process is substantially same as that in first embodiment illustrated in above mentioned FIG. 4.

When the power of the apparatus of which the toner cartridge 13 may have been replaced is turned on, or when the top cover part 1*b* is opened and closed, the main controller 30 controls the RF reading and writing controller 25 and begins RF communication, via the antenna part 26, with the first memory tag 22 included in the image forming part 12 and the second memory tag 23 included in the toner cartridge 13. Then, the main controller 30 reads from the first memory tag 22 the photosensitive body rotation number information and the toner low history information A of the image forming part 12, and reads from the second memory tag 23 the toner low history information B (S201).

The main controller 30 transmits the read photosensitive body rotation number information to the life detection part 51. The life detection part 51 compares the read photosensitive body rotation number information and the life threshold value J1, and transmits a judgment result that indicating whether or not the rotation number of this photosensitive drum 14 is equal to or less than the life threshold value J1 (photosensitive body rotation number≤life threshold value J1) to the main controller 30 (S202-1). When the rotation number of the photosensitive drum 14 exceeds the life threshold value J1 (NO S202-1), the main controller 30 determines that the image forming part 12 including this photosensitive drum 14 has come to its life, displays the notice "the image forming part 12 has come to its life", and stops the print operation (S230).

Meanwhile, in judgment of S102-1, when the rotation number of the photosensitive drum 14 is judged to be equal to or less than the life threshold value J1 (YES, S202-1), the main controller 30 transmits to the life detection part 51 the read photosensitive body rotation number information. Then the life detection part 51 compares the read photosensitive body rotation number information and the life threshold value J2, and transmits a judgment result indicating whether or not the rotation number of this photosensitive drum 14 is equal to or less than the life threshold value J2 (photosensitive body rotation number≤life threshold value J2) to the main controller 30 (S202-2).

When the rotation number of the photosensitive drum 14 exceeds the life threshold value J2 (NO, S202-2), the main controller 30 determines that the image forming part 12 including this photosensitive drum 14 has almost come to its life, proceeds with S103, and thereafter, performs the same process as that explained in above mentioned first embodiment. Meanwhile, in judgment of S102-2, when the rotation number of the photosensitive drum 14 is judged to be equal to or less than the life threshold value J2 (YES, S202-2), the main controller 30 determines that the image forming part 12 including this photosensitive drum 14 has not come to its life yet, proceeds with S110, and thereafter performs the same process as that explained in above mentioned first embodiment.

As mentioned above, in the color printer of the present embodiment, the image forming part 12 including the photosensitive drum 14 sets the rotation number of the photosensitive drum 14 that almost comes to its life (life threshold value J2) and the rotation number that is certainly within a range of the life (life threshold value J1), and performs more appropriate print processes at various stages.

As mentioned above, according to the color printer of the embodiment, same or similar effects as those of the above mentioned color printer of the embodiment are obtained. In addition, according to the accumulated rotation number of the photosensitive drum, more appropriate print processes are performed so as to prevent degradation of print quality.

In the above mentioned embodiments, application to the tandem-type color printer is explained as an example. However, the present invention is not limited to the above discussed embodiments and may be implemented in multifunction printer (MFP) and the like, which have print functions included in a photocopy machine, a facsimile device and the like. In addition, the color printers are explained. However, the printer may be a monochrome printer.

Throughout the entire application, the term "life (or operation life)" of the consumable item, such as the photosensitive drum (or image forming part), means a time limitation after which the consumable item is designed not to be operative with a required quality. For example, as a photosensitive drum is used, its surface is becoming worn out little by little. When the photosensitive drum is used for more than a certain period and the photosensitive drum cannot maintain the image quality that is designed, this is referred as the photosensitive drum comes to the life. On the other hand, when the photosensitive drum is used, but the drum maintains a fine image quality, that is referred as the drum does not come to the life. Conventionally, when the consumable item comes to the life, it means that the item is to be replaced soon. In order to distinct the meaning of life, the term may be used as an operation life instead of life.

What is claimed is:

1. An image forming apparatus, comprising:

an image forming part forming an image on a medium;

a developer containing part containing a developer, removably installed to the image forming part, and supplying the developer to the image forming part;

a first memory part included in the image forming part and storing first usage information and second usage information, the first usage information regarding a use amount of the image forming part and the second usage information regarding a developer history;

a second memory part included in the developer containing part and storing third usage information regarding a developer history, a controller reading and storing the first and second usage information from and to the first memory part, reading and storing the third usage information from and to the second memory part, and controlling image formation by the image forming part, and a remaining developer amount detection part detecting a remaining amount of the developer, which exists in the developer containing part, wherein (0) the controller determines if the use amount of the image forming part is equal to or smaller than a predetermined value based on the first usage information (S102), (1) when Yes, the controller determines if the developer history indicates low based on the third usage information stored in the second memory part (S110), (2) when No, the controller determines if the developer history indicates low based on the second usage information stored in the first memory part (S103), further (2a) when Yes, the controller stops the image formation (S104), (2b) when No, the controller executes the image formation (S107, S108), and activates the remaining developer amount detection part to detect if the remaining amount of the developer in the developer containing part (S105) is low, (2b-i) when Yes, the controller rewrites the developer histories in the first and second memory parts to indicate that the remaining amount of the developer is low (S106), (2b-ii) when No, the controller does not rewrite the first or second memory part to indicate that the remaining amount of the developer is low.

2. The image forming apparatus of claim 1, further comprising:

a display part displaying an apparatus state, wherein when the controller determines that the developer history indicates low based on the second usage information (S103, Yes), the controller displays on the display part as the apparatus state that the image forming part has come to an operation life thereof so that a user is notified of a timing to replace the image forming part, and stops the image formation by the image forming part (S104).

3. The image forming apparatus of claim 1, wherein the controllers rewrites the second and third usage information when the detected remaining amount of the developer by the remaining developer amount detection part is lower than a predetermined amount (S105, Yes).

4. The image forming apparatus of claim 1, further comprising:

a display part displaying an apparatus state, wherein when the developer history in the first memory does not indicate low (S103, No), the controller displays on the display part as the apparatus state that the image forming part has come to an operation life thereof (S107, S108).

5. The image forming apparatus of claim 1, further comprising:

a display part displaying an apparatus state, wherein when the controller determines that the detected remaining amount of the developer by the remaining developer amount detection part is lower than the predetermined amount (S105, Yes), the controller displays on the display part as the apparatus state that the image forming part has come to an operation life thereof and that the remaining amount of the developer is low (S107).

6. The image forming apparatus of claim 4, wherein the controller detects the use amount of the image forming part after the image formation and updates the first usage information.

7. The image forming apparatus of claim 1, further comprising:

a display part displaying an apparatus state, wherein when the controller determines that the developer history indicates low based on the third usage information (S110, Yes), the controller displays on the display part as the apparatus state that the remaining amount of the developer is low (S111).

8. The image forming apparatus of claim 1, further comprising:

a life detection part that is connected to the controller, includes first life threshold value (J1) and second life threshold value (J2), the second life threshold value (J2) being smaller than the first threshold value (J1), wherein when the use amount of the image forming part in the first memory exceeds the first life threshold value (J1) (S202-1, YES), the controller immediately stops the image formation (S230), and when the use amount of the image forming part in the first memory does not exceed the first life threshold value (J1) (S202-1, NO), the controller determines if the use amount of the image forming part exceeds the second life threshold value (J2) (S202-2), and when the use amount of the image forming part exceeds the second life threshold value (J2) (S202-2, NO), the controller proceeds in a process to determine if the remaining amount of the developer indicates low based on the second usage information stored in the first memory part (S103), when the accumulated use amount of the image forming part does not exceed the second life threshold value (J2) (S202-2, YES), the controller proceeds in a process to determine if the developer history indicates low based on the third usage information stored in the second memory part (S110).

9. The image forming apparatus of claim 1, wherein the controller activates the remaining developer amount detection part when power of the apparatus is turned on.

10. An image forming apparatus, comprising:

an image forming part forming an image on a medium;

a developer containing part containing a developer, removably installed to the image forming part, and supplying the developer to the image forming part;

a memory part included in the image forming part and storing first usage information and second usage information, the first usage information regarding a use amount of the image forming part and the second usage information regarding a developer history;

a controller reading and storing the first and second usage information from and to the memory part, and controlling image formation by the image forming part, and a remaining developer amount detection part detecting a remaining amount of the developer, which exists in the developer containing part, wherein (0) the controller determines if the use amount of the image forming part is equal to or smaller than a predetermined value based on the first usage information (S102), (1) when Yes, the controller determines if the developer history indicates low based on the second usage information stored in the memory part (S110), then (1a) executes the image formation when the developer history does not indicate low (S114, 115), (1b) does not execute the image formation when the developer history indicates low (S111), (2) when No, the controller determines if the remaining amount of the developer indicates low based on the second usage information stored in the memory part (S103), further (2a) when Yes, the controller stops the image formation (S104), (2b) when No, the controller executes the image formation (S107, S108), activates the remaining developer amount detection part to detect if the remaining amount of the developer in the developer containing part (S105) is low, (2b-i) when No, the controller does not rewrite the developer history in the memory part to indicate that the remaining amount of the developer is low, (2b-ii) when Yes, the controller rewrites the developer history in the memory part to indicate that the remaining amount of the developer is low (S106).

11. The image forming apparatus of claim 10, wherein the predetermined value, which is used by the controller to determine if the use amount of the image forming part is equal to or smaller, is an operation life, and the operation life is a threshold up to which a certain quality of the image formation is expected, but after which the certain quality of the image formation is not expected.

12. The image forming apparatus of claim 10, wherein the predetermined value, which is used by the controller to determine if the use amount of the image forming part is equal to or smaller, is a threshold designed for indicating to replace the image forming part.

* * * * *